United States Patent [19]

Lehner

[11] 4,090,379

[45] May 23, 1978

[54] AUTOMOBILE DOOR LATCH AND LOCK PROTECTING DEVICE AND METHOD FOR PREVENTING FREEZING OF DOOR LATCHES AND LOCKS

[76] Inventor: Walter H. Lehner, 1231 Pulaski St., Lincoln, Ill. 62656

[21] Appl. No.: 766,882

[22] Filed: Feb. 9, 1977

[51] Int. Cl.[2] ..... E05B 19/16
[52] U.S. Cl. ..... 70/455; 292/251.5
[58] Field of Search ..... 70/455; 292/251.5

[56] References Cited

U.S. PATENT DOCUMENTS

| | | | |
|---|---|---|---|
| 2,639,751 | 5/1953 | Flaherty | 292/251.5 |
| 3,434,318 | 3/1969 | Thiry | 70/455 |
| 3,861,182 | 1/1975 | Skinner | 70/455 |

*Primary Examiner*—Richard E. Moore
*Attorney, Agent, or Firm*—Grace J. Fishel

[57] ABSTRACT

A protecting device for door latches and locks in vehicles exposed to the elements, said device including a flexible magnetic frame for sealing a water repellent frangible sheet of material over the door latch or lock.

A method for preventing freezing of door latches and locks in vehicles exposed to the elements, said method utilizing said protective device.

1 Claim, 8 Drawing Figures

AUTOMOBILE DOOR LATCH AND LOCK PROTECTING DEVICE AND METHOD FOR PREVENTING FREEZING OF DOOR LATCHES AND LOCKS

This invention relates to a protector for door latches and locks of vehicles such as automobiles and to a method for preventing freezing of door latches and locks.

As most motorists know, occasionally car door latches and locks become frozen. This occurs primarily when the car is left exposed to the elements, particularly during periods of freezing rain. It can occur, however, even when the car is in a garage if the lock or latch is wet and the temperature then drops below zero.

There are various techniques for thawing out latches and locks. One of these consists of pouring warm water on the frozen part. This is quite effective if there is an ample supply of hot water nearby but, if not, can further add to the problem.

Another method is to blow hot air on the frozen part. This is also effective if the motorist has a portable space heater or a hair dryer handy and a source of electricity.

Many times, however, and most, it seems, door latches and locks freeze when the motorist is far from the means necessary to apply the above-mentioned home remedies.

Therefore, among the several objects of the present invention may be noted the provision of a protector for door latches and locks to prevent the freezing thereof. Another object is to provide such a protector which is also inexpensive to buy and use and easy to apply and remove without tools or other equipment. Still another object is to provide a method for preventing freezing of door latches and locks. Other objects and features will be in part apparent and in part pointed out hereinafter.

The invention accordingly comprises the device and method hereinafter described, the scope of the invention being indicated in the subjoined claims.

In the accompanying drawings, in which one of various possible embodiments of the invention is illustrated, corresponding reference characters refer to corresponding parts throughout the several views of the drawings, and FIG. 1 is a rear perspective view of an automobile with a protector device according to the present invention applied to the door latch and lock on the driver's side;

Figure 1:
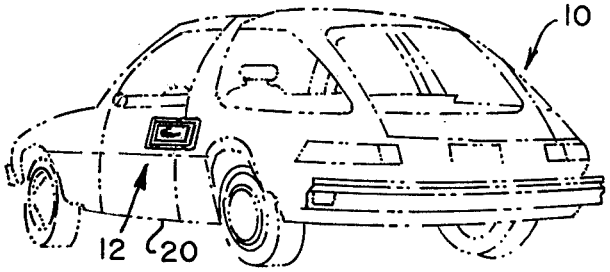
Figure 2:
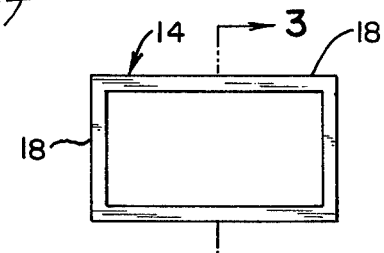
FIG. 2 is a plan view of a flexible magnetic frame shown in use in FIG. 1.
Figure 3:
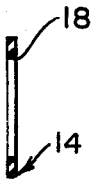
FIG. 3 is a cross-sectional view of the frame taken along line 3—3 in FIG. 2.
Figure 4:
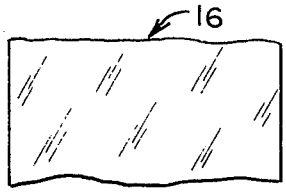
FIG. 4 is a plan view of a sheet of water repellent frangible material shown in use in FIG. 1.
Figure 6:
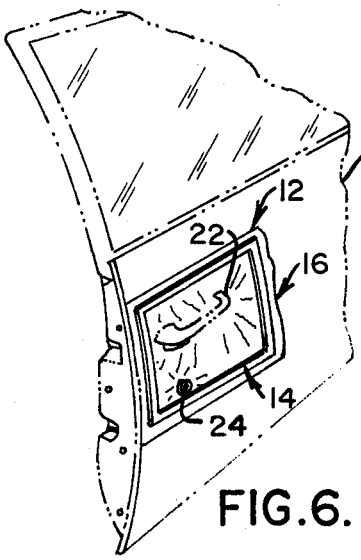
FIG. 6 is a perspective view similar to FIG. 5 except that the sheet of frangible material is held in place with the flexible magnetic frame shown in FIG. 2.

Referring now to FIG. 1, there is shown an automobile 10 with a protector 12 in accordance with the present invention. As best seen in FIG. 6, protector 12 includes a flexible magnetic frame 14 and a frangible sheet of material 16 for use as described below.

Frame 14 is preferably constructed of sturdy flexible magnetic strips 18. While frame 14 is shown as rectangular it can be formed in some other geometric configuration as desired. As shown in the drawings, strips 18 function to hold frangible sheet 16 in place on a car door 20 over a selected latch 22 and lock 24.

If door 20 is not curved adjacent latch 22 and lock 24, frame 14 need not be flexible. However, since most car doors are so curved, frame 14 is preferably flexible to be universally adaptable for use on any car door.

Frangible sheet of material 16 is preferably formed of some material which is inexpensive and readily available to the motorist. For this purpose, it is preferred that the material be aluminum foil or plastic wrap since these materials are commonly kept on hand. Other frangible films, however, which are also water repellent are contemplated. Such materials, for example, include waxed paper, oiled paper or the like.

As shown, the same frangible sheet 16 covers both latch 22 and lock 24. Depending on the car, however, separate protectors 12 can be used for the latch and for the lock. Where these are located close together, however, it is preferred to use one frame 14 and one sheet of material 16 for simplicity in protecting both.

Figure 5:
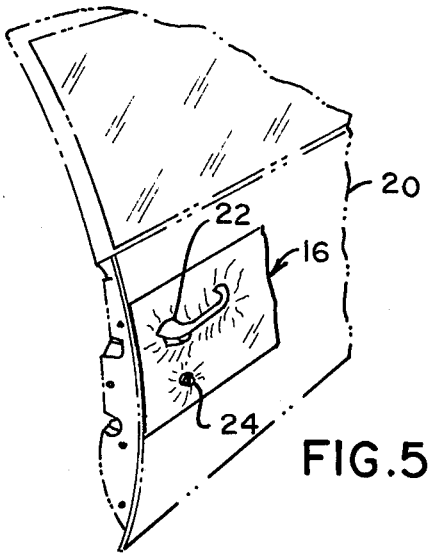
FIG. 5 is a perspective view of a car door, part of which has been broken away for clarity of illustration, with the latch and lock covered with the sheet of frangible material shown in FIG. 4.

When the latch and lock are positioned as shown in the drawings, a sheet of frangible material 16 is held over both as shown in FIG. 5. Such a sheet is easily dispensed as from a household roll of aluminum or plastic wrap.

Using one hand to temporarily hold sheet 16 over latch 22 and lock 24, the motorist's other hand is used to place frame 14 thereover in magnetic contact through sheet 16 with the metal in door 20 as shown in FIG. 6. Frame 14 is then pushed tightly against door 20 leaving a protruding dome of material sticking out through the center and forming a protective tent over the latch or lock.

Figure 7:
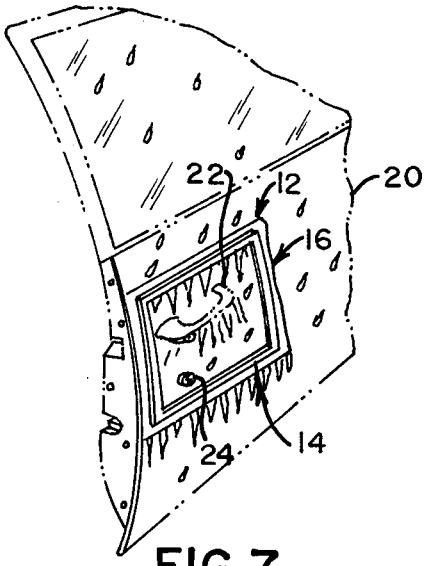
FIG. 7 is a perspective view similar to FIG. 6 except showing the door exposed to freezing rain; and, FIG. 8 is a perspective view similar to FIG. 7 except showing the frangible material after it has been ruptured to expose the heretofore protected latch and lock in said door after being exposed to freezing rain as shown in FIG. 7.

With sheet 16 secured to door 20 by frame 14, protector 12 is firmly held thereon. So positioned, the protector is held in place and resists separation from the car door even by strong wind or freezing rain as shown in FIG. 7.

Moreover, since frame 14 is flexible to conform to door 20, the frame seals frangible sheet 16 thereto. So done, there are substantially no gaps for water to run thereunder and thus defeat the purpose of protector 12.

Figure 8:
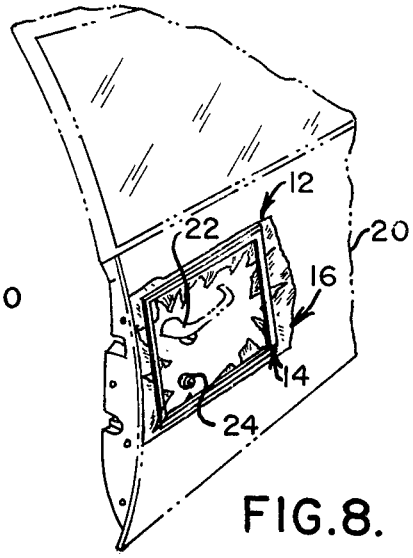

If the protector is iced over when the motorist is ready to open door 20, the motorist ruptures frangible sheet 16 as shown in FIG. 8. This is accomplished by tapping on the sheet protruding through the frame and forming a tent over the latch or lock and tearing it. Protected latch 22 and lock 24 are thus exposed for use. Frame 14 and sheet 16 are left in place for later removal, as desired, if frozen and removed when the ice melts. When they are removed, sheet 16 is disposed of and frame 14 is ready for reuse.

If protector 12 is not iced over, frame 14 and sheet 16 are merely pulled off for reuse. If protectors 12 are installed on all of the doors and not all are opened, car 10 can be driven with the protectors in place.

In view of the above, it will be seen that the several objects of the invention are achieved and other advantageous results attained. As various changes could be made in the above described device without departing from the scope of the invention, it is intended that all matter contained in the description or shown in the accompanying drawings shall be interpreted as illustrative and not in a limiting sense.

What is claimed is:

1. A method for preventing freezing of vehicle door latches and locks which comprises:

a. holding a sheet of water repellent, frangible material over said latch or lock;

b. bringing a flexible magnetic frame into magnetic contact with the vehicle door, said frame surrounding the latch or lock and sealing the frangible material to the vehicle door and providing a protective tent over said latch or lock;

c. leaving the frame and frangible material in place while the vehicle is exposed to the elements;

d. rupturing the frangible material to expose the protected latch or lock; and, e. removing the frame and ruptured frangible material from the vehicle door.

* * * * *